US009456695B2

(12) United States Patent
Koch

(10) Patent No.: US 9,456,695 B2
(45) Date of Patent: Oct. 4, 2016

(54) MANUAL CONTROL COMPONENT FOR AN ELECTRICALLY ADJUSTABLE PIECE OF FURNITURE AND ELECTRICALLY ADJUSTABLE PIECE OF SEATING FURNITURE

(71) Applicant: LOGICDATA Electronic & Software Entwicklungs GmbH, Deutschlandsberg (AT)

(72) Inventor: Walter Koch, Schwanberg (AT)

(73) Assignee: LOGICDATA ELECTRONIC & SOFTWARE ENTWICKLUNGS GMBH, Deutschlandsberg (AT)

( * ) Notice: Subject to any disclaimer, the term of this patent is extended or adjusted under 35 U.S.C. 154(b) by 90 days.

(21) Appl. No.: 14/205,231

(22) Filed: Mar. 11, 2014

(65) Prior Publication Data

US 2014/0346839 A1 Nov. 27, 2014

(30) Foreign Application Priority Data

May 21, 2013 (DE) ..... 10 2013 105 176

(51) Int. Cl.

| | |
|---|---|
| ***A47C 7/02*** | (2006.01) |
| ***A47C 31/00*** | (2006.01) |
| ***A47C 1/024*** | (2006.01) |
| *A47C 1/02* | (2006.01) |

(52) U.S. Cl.

CPC ..... *A47C 7/02* (2013.01); *A47C 1/0242* (2013.01); *A47C 31/008* (2013.01)

(58) Field of Classification Search

CPC ..... A47C 7/02; G08C 23/04; H01H 9/0235; H01H 2009/0257

USPC ..... 340/825, 12.22; 5/1, 7; 341/176; 200/339, 553

See application file for complete search history.

(56) References Cited

U.S. PATENT DOCUMENTS

| | | | | |
|---|---|---|---|---|
| 4,015,639 | A * | 4/1977 | Koch | D03C 9/0675 139/92 |
| 4,156,227 | A * | 5/1979 | Villar | H01C 10/36 338/172 |
| 5,658,238 | A * | 8/1997 | Suzuki | A61B 1/00039 600/146 |
| 6,573,854 | B1 * | 6/2003 | Hug | G08C 23/04 200/18 |
| 7,633,401 | B1 * | 12/2009 | Copley | A47C 31/008 297/260.2 |
| 2009/0185403 | A1 * | 7/2009 | Koch | H02P 7/295 363/126 |

(Continued)

FOREIGN PATENT DOCUMENTS

| | | |
|---|---|---|
| DE | 7505782 U | 6/1975 |
| DE | 202004002924 U1 | 7/2005 |

*Primary Examiner* — Travis Hunnings
*Assistant Examiner* — Omar Casillashernandez
(74) *Attorney, Agent, or Firm* — McDermott Will & Emery LLP

(57) ABSTRACT

A manual control component (100) for an electrically adjustable piece of furniture comprises a housing (110) and a switch element (120) with an upper part (130) that features a flat, upwardly directed control panel (132) with a first and a second control surface (134, 136), as well as a lower part (140) that features a downwardly directed control lever (142). The lower part is coupled to the upper part in an essentially rigid fashion. The switch element is pivotably supported in the housing (110). The manual control component (100) further comprises a circuit arrangement (150) that is designed for detecting a pivoting motion of the switch element (120) and for generating a signal in order to activate a drive of the piece of furniture (200) in dependence on the detected pivoting motion.

18 Claims, 3 Drawing Sheets

(56) References Cited

U.S. PATENT DOCUMENTS

2011/0021271 A1* 1/2011 Ikeda ..... A63F 13/06 463/30

2011/0296607 A1* 12/2011 Stadlthanner ..... A61G 7/018 5/11

2012/0033449 A1* 2/2012 Koch ..... H02M 1/36 363/15

* cited by examiner

MANUAL CONTROL COMPONENT FOR AN ELECTRICALLY ADJUSTABLE PIECE OF FURNITURE AND ELECTRICALLY ADJUSTABLE PIECE OF SEATING FURNITURE

CROSS-REFERENCE TO RELATED APPLICATION

The present application claims priority to German Patent Application No. 102013105176.6, filed on May 21, 2013, which is hereby incorporated by reference in its entirety for all purposes.

DESCRIPTION

The invention pertains to a manual control component for an electrically adjustable piece of furniture, particularly a piece of seating furniture, as well as to an electrically adjustable piece of seating furniture with such a manual control component.

Furniture is nowadays frequently equipped with an electrical adjusting mechanism. In this case, the actuation is often realized with manual control components that are coupled to the corresponding control units or drives of the respective piece of furniture. For this purpose, two or more buttons that make it possible to adjust the piece of furniture are usually arranged on conventional manual control components.

An objective to be achieved can be seen in disclosing a more flexible concept for the control of electrically adjustable furniture.

This objective is achieved with the subject-matter of the independent claims. Enhancements and embodiments of the more flexible concept are defined in the dependent claims.

The flexible concept is based on the notion of equipping the manual control component for an electrically adjustable piece of furniture with a special switch element that allows control based on different actuations by a user. In this case, the switch element is realized in such a way that it is possible on the one hand to control the switch element on an upper side of the manual control component, for example by actuating or pressing corresponding control surfaces, and on the other hand to actuate the switch element on the underside by respectively actuating or moving a lever or lever-like element thereof.

An upper part of the switch element on which the control surfaces are situated, and a lower part of the switch element on which the control lever is situated are in this case connected to one another in a rigid or essentially rigid fashion. The switch element, in particular, is pivotably supported in the housing such that an evaluation of the respective pivoting motion can be realized with simple means, particularly with a joint evaluation for the entire switch element.

The construction consisting of the housing of the manual control component and the switch element is preferably realized in such a way that the control lever protrudes from the housing, particularly from a contour of the housing, such that the control lever can also be actuated by pressing the housing against a more or less firm surface at the location of the control lever in order to thusly move the control lever. The position or the pivoting motion of the switch element is respectively evaluated, for example, by means of a circuit arrangement that can subsequently generate corresponding signals for activating a drive of the piece of furniture. Such a manual control component is particularly suitable for seating furniture such as, for example, armchairs or adjustable loungers. The manual control component according to the flexible concept can also be easily actuated by persons with poor or impaired motor skills. The manual control component therefore is also suitable for furniture used, for example, in the nursing care sector.

An exemplary embodiment of the manual control component according to the flexible concept comprises a housing and a switch element with an upper part that features a flat, upwardly directed control panel with a first or a second control surface, as well as a lower part that features a downwardly directed control lever and is coupled to the upper part in an essentially rigid fashion. In this case, the switch element is pivotably supported in the housing. A circuit arrangement is further provided in the housing and is designed for detecting a pivoting motion of the switch element, as well as for generating a signal for the activation of a drive of a piece of furniture in dependence on the detected pivoting motion.

During the detection of the pivoting motion, for example, a pivoting angle of the switch element can be determined in order to thusly generate the corresponding signals in the circuit arrangement in dependence on the pivoting angle. The detection of the pivoting motion may alternatively also be limited to the detection of three possible positions, namely a neutral position that corresponds to an idle state and two directional positions that respectively correspond to one of the two possible actuating directions.

For example, the manual control component comprises a first and a second switch that may be realized, in particular, in the form of microswitches. The first and the second switch are electrically coupled to the circuit arrangement. The first switch can be respectively actuated due to an actuation of the first control surface or an actuation of the control lever in a first direction. Similarly, the second switch can be respectively actuated due to an actuation of the second control surface or an actuation of the control lever in a second direction. Consequently, the evaluation of the position of the switch element or the detection of the pivoting motion can be realized with little effort by providing only two switches, particularly microswitches.

However, the evaluation may, in principle, also be realized with other means that generally are familiar to a person skilled in the art.

In an embodiment of the manual control component, the circuit arrangement is at least partially arranged on a circuit board in the interior of the housing. In this case, the first and the second switch are fixed on the circuit board and electrically contacted. The circuit board preferably extends in a region of the housing in which the switch element is supported.

In the potential embodiments of the manual control component, the switch element is preferably supported in the housing in such a way that the control panel on the upper part can only be actuated on an upper side of the housing. The control lever, in contrast, can only be actuated on an underside of the housing. For example, the switch element accordingly is completely enclosed by the housing, particularly in such a way that only the control panel and part of the control lever are visible from the outside and can thereby be actuated. The upper side and the underside of the housing are respectively defined by the aforementioned positioning of the switch element. The upper side and the underside particularly are two opposite sides of the housing.

The switch element is preferably supported in the manual control component such that it can be pivoted about an axis that is essentially arranged parallel to an upper side of the housing. With respect to its motion, the switch element therefore has only one degree of freedom, namely the rotation about this axis. Even if the housing does not feature a completely plane surface on its upper side, it is usually still possible to recognize a principal plane that forms the basis for the alignment of the axis.

The axis is formed, for example, by a pin that is supported in the housing and consists, in particular, of metal or sturdy plastic. For example, the switch element features a feedthrough or a hole for accommodating the pin in the region of the intended pivoting axis.

In different embodiments, the switch element features means for resetting the switch element into a neutral position. This makes it possible to ensure that no additional signals are delivered to the drive of the piece of furniture once the switch element is no longer intentionally pivoted. The resetting means comprise, for example, at least one spring, preferably at least two springs. If only a single spring is provided, this spring would have to be able to absorb tensile and compressive stresses. With two springs, one spring could be provided for each of the possible moving directions or pivoting directions.

In different embodiments, the upper and/or the lower part of the switch element is/are made of plastic, particularly of ABS plastic. In this context, ABS is the abbreviation for acrylonitrile butadiene styrene. The plastic design of the switch element makes it possible to achieve a stable construction on the one hand and a low weight of the manual control component on the other hand.

The upper and the lower part may in different embodiments consist of individual components that are joined into the switch element. A rigid or essentially rigid overall body is preferably produced in this case. In other embodiments, the upper and the lower part of the switch element may be jointly realized in the form of a one-piece component. For example, the upper and the lower part may be jointly manufactured in the form of a one-piece plastic component.

In different embodiments, the underside of the housing features in the region of the switch element or in the region of the control lever a recess, into which a user of the manual control component can reach in order to actuate the control lever. In addition to the intended pivoting range of the control lever on the underside of the housing, this also provides a larger contact surface of the control lever for the user such that an actuation on the side of the control lever can be realized in an even simpler fashion.

The flexible concept can also be realized in an electrically adjustable piece of seating furniture that features a manual control component according to one of the above-described embodiments.

The piece of seating furniture may consist, for example, of a chair, an armchair, particularly an upholstered armchair, a sofa, a couch, a lounger or a bed. The piece of seating furniture may also have additional adjusting functions that can be controlled with other conventional control elements on the manual control component. In addition, the piece of seating furniture may also have other comfort functions such as, for example, a massage function, a heater or the like. Corresponding control elements for these functions also need to be provided on the manual control component.

Several exemplary embodiments of the invention are described in greater detail below with reference to the figures. Components with identical function or identical effect are identified by the same reference symbols. The description of individual elements with reference to one of the figures is not necessarily repeated with reference to the following figures.

Figure 1:
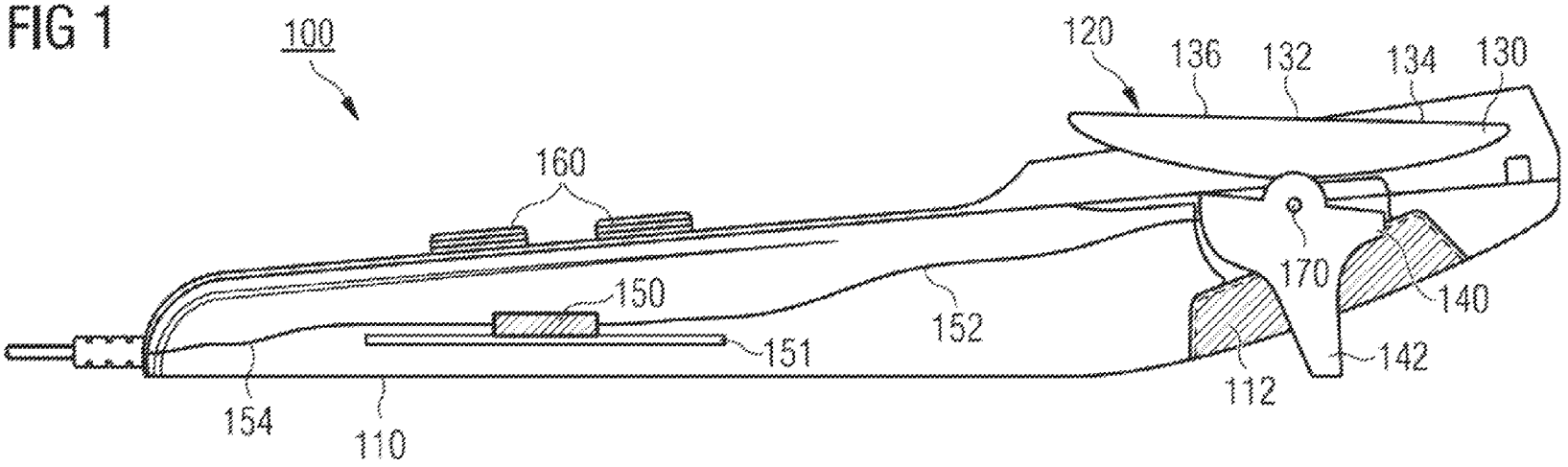
FIG. 1 shows an embodiment of a manual control component.

FIG. 1 shows a manual control component 100 for an electrically adjustable piece of furniture with a housing 110 and a switch element 120 arranged therein. The illustration in FIG. 1 is essentially a cross-sectional illustration. The switch element 120 features an upper part 130 and a lower part 140 that are respectively coupled or connected to one another in a rigid or essentially rigid fashion. The upper part 130 features an upwardly directed control panel 132 with a first control surface 134 and a second control surface 136 that are also directed upward. The lower part 140 features a downwardly directed control lever 142. In the embodiment shown, this control lever protrudes from the housing 110, particularly from a contour of the housing 110. The switch element 120 is pivotably supported in the housing 110, wherein the pivoting motion takes place about an axis 170.

A circuit arrangement 150 is furthermore provided in the housing 110 and arranged on a circuit board 151. The circuit arrangement 150 is connected to evaluation means in the region of the switch element 120 via a symbolically illustrated line 152, wherein said evaluation means make it possible to detect the degree of a pivoting motion of the switch element 120. The evaluation means are not illustrated in this figure in order to provide a better overview. For example, they may be formed by switches, particularly microswitches. However, other methods may also be used for detecting the degree of pivoting motion. The circuit arrangement 150 also features an outgoing connection, particularly to the electrically adjustable piece of furniture or a control unit or a drive of the piece of furniture, in the form of a symbolically illustrated line 154.

Additional control elements 160 are provided on the upper side of the housing 110, wherein the actuation of these additional control elements can also be evaluated by the circuit arrangement 150.

In the arrangement illustrated in FIG. 1, the switch element 120 can be actuated on the upper side of the housing 110, as well as on the underside. The control surfaces 134, 136 can only be actuated, in particular, from the upper side while the control lever 142 can only be actuated from the underside. When the switch element 120 is actuated, an actuation on the upper side also leads to a motion of the control lever 142 on the underside and vice versa. Accordingly, it suffices to provide only one set of evaluation means for the evaluation of the pivoting motion and therefore of a switching position of the switch element 120.

For example, two moving directions of the connected piece of furniture such as, for example, raising or lowering a backrest of an armchair or the like can be controlled with the two control surfaces 134, 136. It accordingly suffices, for example, to provide one microswitch for each of the moving directions, wherein said microswitch is triggered when the switch element is correspondingly actuated by pressing the control surfaces 134, 136 or by moving the control lever 142.

The circuit arrangement 150 capable of detecting a pivoting motion of the switch element is designed for generating a signal for the activation of a drive of the piece of furniture in dependence on the detected pivoting motion. During a corresponding actuation or a corresponding pivoting motion, for example, respectively required control signals are delivered to a control unit via the line 154. It is alternatively also possible to directly connect the motors of the drive to a driving voltage in the manual control component 100 by means of the circuit arrangement 150. Additional functions such as, for example, other motion controls or comfort functions such as massage, heater or the like can also be controlled by the circuit arrangement based on the actuation of the control elements 160.

The axis 170 is formed, for example, by a pin (not visible) that is supported in the housing 110 and consists, for example, of metal or a sturdy plastic. The axis 170 preferably extends essentially parallel to an upper side of the housing and preferably perpendicular to a principal longitudinal direction of the manual control component.

In the region of the control lever 142, the housing 110 is provided with a recess 112, into which a user of the manual control component 100 can reach in order to actuate the control lever 142. The recess 112 is realized, in particular, larger than necessary for the proper operation of the control lever 142. This allows a simpler haptic actuation of the control lever and provides an enlarged contact surface on which a user can actuate the control lever 142.

According to another characteristic of the switch element 120 shown, the control surfaces 134, 136 make it possible to realize an actuation on the upper side by purposefully pressing or tapping the control surfaces. This usually requires more advanced motor skills of a user than the actuation of the control lever 142. With respect to its optical appearance, however, the upper control panel 132 rather corresponds to known control mechanisms. The actuation of the control lever 142 also enables users with impaired motor skills to control certain basic functions of the connected adjustable piece of furniture such as, for example, lowering or raising a backrest of an armchair. To this end, it suffices to simply pivot the control lever 142 with the fingers.

On the other hand, it is also possible to place the entire manual control component 100 onto a more or less firm surface such as an armrest of a chair in the region of the control lever 142 and to actuate the control lever 142 by applying corresponding pressure. If the control lever 142 is placed onto a firm surface in this way, the lever 142 can be pressed rearward by moving the manual control component 100 upward or toward the right in the illustration in FIG. 1, wherein this corresponds to an actuation of the first control surface 134. Similarly, the control lever 142 can be pressed forward by moving the entire manual control component 100 rearward or toward the left in the illustration in FIG. 1, wherein this corresponds to an actuation of the second control surface 136. For a user with impaired motor skills, it therefore suffices to move the entire control element 100 on the firm surface in order to trigger a corresponding actuation. A direct actuation of the control lever 142 with a finger is not required in this case.

The manual control component 100 according to FIG. 1 therefore can be controlled in a more flexible fashion. The manual control component 100 provides three different actuating options, in particular, in the form of a direct actuation of the control panel 132, a direct actuation of the control lever 142 and an indirect actuation of the control lever 142.

Figure 2:
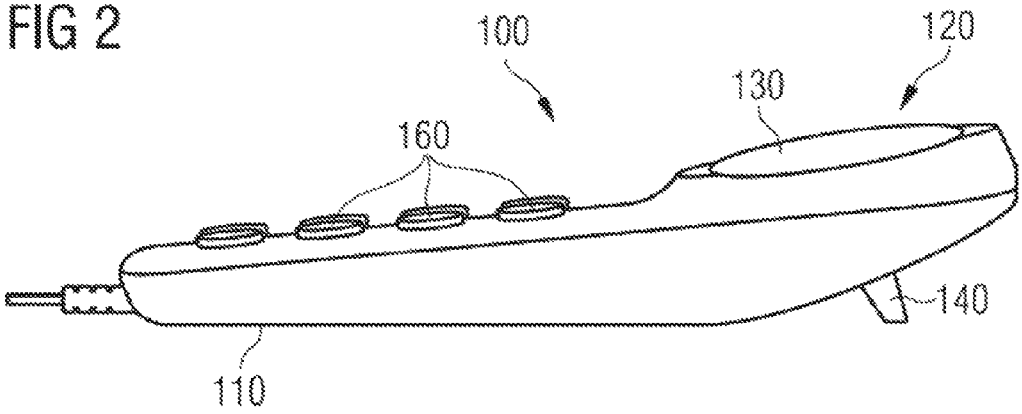
FIG. 2 shows another embodiment of a manual control component.

FIG. 2 shows another embodiment of a manual control component 100 that is essentially based on the embodiment described with reference to FIG. 1. In contrast to the above-described embodiment, a greater number of additional control elements 160 are provided in the embodiment in FIG. 2. These additional control elements make it possible to control other adjusting functions or comfort functions of the connected piece of furniture.

In both described embodiments, a primary function with the connected piece of furniture is distinguished from secondary functions by providing the switch element 120 and the control elements 160. For example, persons with impaired motor skills can trigger the primary functions with the above-described actuating options of the switch element 120. The secondary functions, as well as the primary function, can then be triggered with the same manual control component, for example, by another person with suitable motor skills such as, for example, nursing care personnel. Another control element, for example, for nursing care personnel in addition to the control element for the user with impaired motor skills therefore can be efficiently eliminated.

Figure 3A:
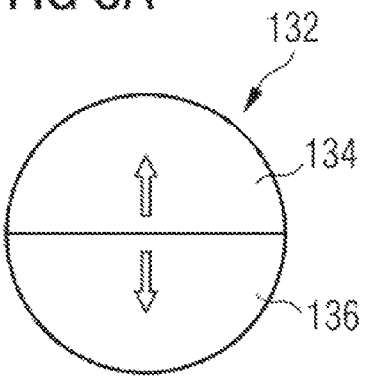
FIG. 3A and FIG. 3B show different views of a switch element.
Figure 3B:
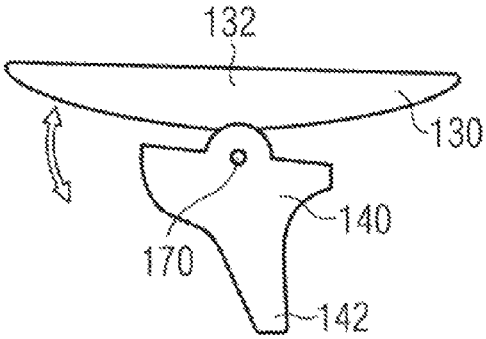

FIG. 3A and FIG. 3B show different views of an embodiment of the switch element 120. In this case, FIG. 3A shows a top view of the switch element 120, in which the control panel 132 with the first and second control surfaces 134, 136 is illustrated. The control panel 132 is realized, for example, with a round shape, particularly a circular shape. In this case, the upper half identified by an upward arrow forms the first control surface while the lower half identified by a downward arrow forms the second control surface 136.

FIG. 3B shows a cross-sectional view of the switch element 120 with the upper part 130 and the lower part 140, both of which are realized in one piece in the embodiment shown. The upper part and the lower part 130, 140 therefore are rigidly coupled. For example, the switch element 120 is made of plastic, particularly ABS plastic. The switch element 120 respectively features a feedthrough or a hole for the axis 170 about which the switch element can be pivoted.

Figure 4:
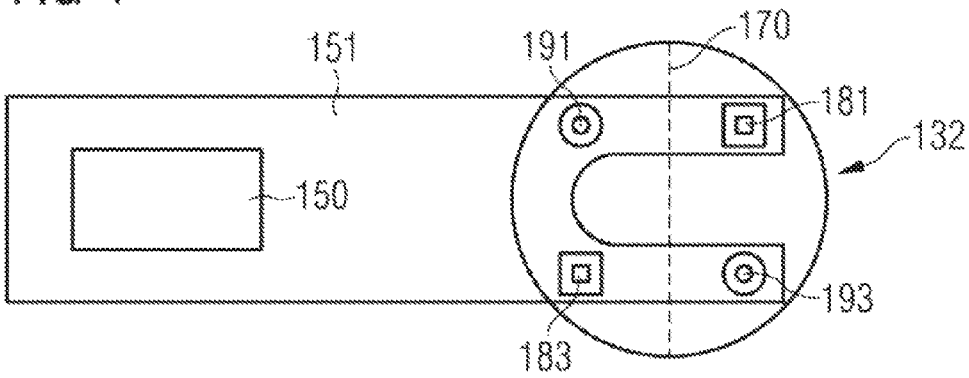
FIG. 4 shows a schematic view of a detail of an embodiment of a manual control component.

FIG. 4 shows a detail of an embodiment of a manual control component, in particular, with the circuit board 151 and the circuit arrangement 150 arranged thereon, as well as additional elements arranged on the circuit board. A first and a second microswitch 181, 183, in particular, are provided on the circuit board 151 and are electrically connected to the circuit arrangement 150. An actuation on the schematically illustrated control panel 132 respectively leads to the actuation of one of the microswitches 181, 183. Corresponding springs 191, 193 are provided in order to realize a reset into a neutral position after an actuation, i.e., when the control panel 132 is released. Resetting means other than the springs 191, 193 may also be provided. The microswitches 181, 183 and the springs 191, 193 are arranged to the left and to the right of the pivoting axis 170.

Figure 5:
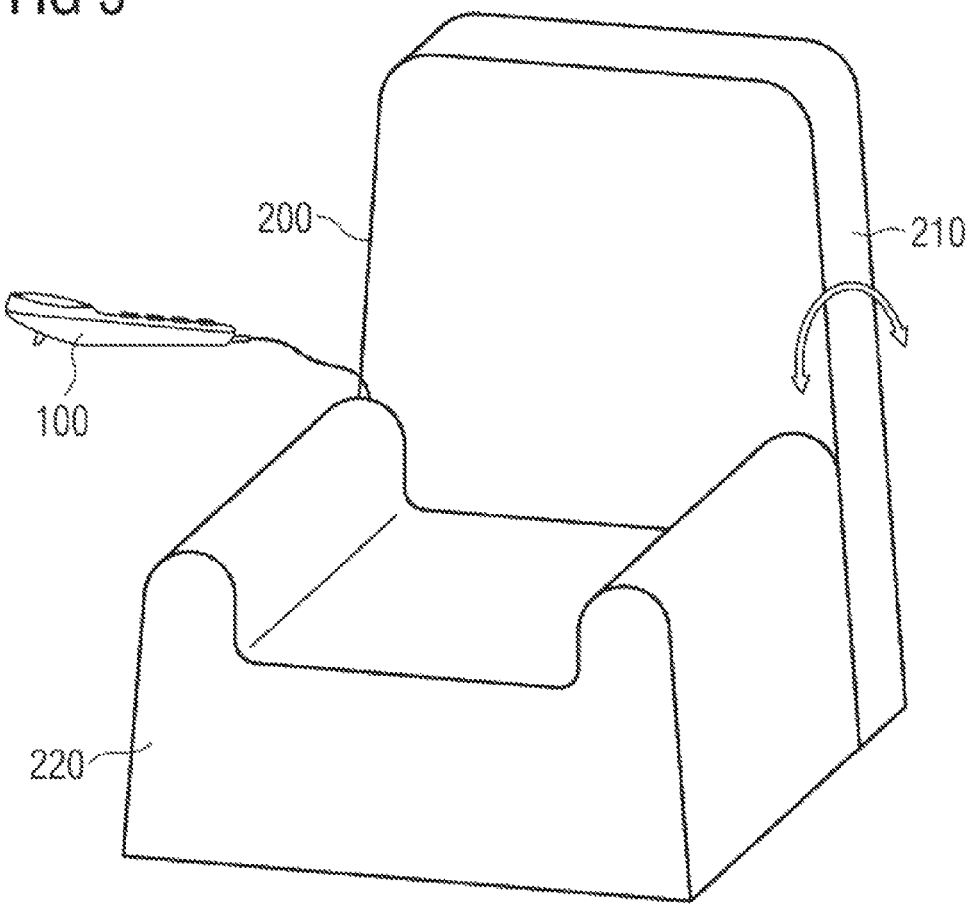
FIG. 5 shows an embodiment of a piece of seating furniture with a manual control component.

FIG. 5 shows an exemplary embodiment of an electrically adjustable piece of seating furniture 200 in the form of an armchair with adjustable backrest 210. The piece of seating furniture 200 further features a stationary element 220. Internally arranged motors that carry out the adjusting function are not visible in this figure. In addition, the armchair 200 may have at least one controlled comfort function such as, for example, a massage function, into which one or more massaging motors are additionally integrated. These motors are also not illustrated in this figure in order to provide a better overview.

Other comfort functions include, for example, the adjustment of a headrest, a seat heater, audio functions, the control of an external voltage supply or the like. A manual control component 100 according to one of the above-described embodiments is connected to the piece of seating furniture 200. An adjustment of the backrest 210 can be realized, in particular, by actuating the primary function in the form of the switch element 120.

It is to be noted that the illustration of the armchair 200 serves merely as an example of a piece of electrically adjustable sitting furniture; such sitting furniture, however, also includes chairs, sofas, seating areas, beds or the like.

Such an armchair may also be realized, in particular, in the form of a lounger or recliner. In this case, the function of the switch element 120 includes the movement of the recliner from a reclining position into a sitting position and vice versa.

The invention claimed is:

1. A manual control component for an electrically adjustable piece of furniture, the manual control component comprising:

a housing;

a switch element with an upper part that features a flat, upwardly directed control panel with a first and a second control surface, as well as a lower part that features a downwardly directed control lever that is directly connected to the upper part in a rigid fashion, wherein the switch element is pivotably supported in the housing;

a circuit arrangement that is designed for detecting a pivoting motion of the switch element and for generating a signal in order to activate a drive of the piece of furniture in dependence on the detected pivoting motion; and wherein the upwardly directed control panel moves with an actuation of the downwardly directed control lever.

2. The manual control component according to claim 1, wherein the switch element is supported in the housing in such a way that the control panel is only actuatable on an upper side of the housing and the control lever can is only actuatable on an underside of the housing.

3. The manual control component according to claim 1 or 2, wherein the control lever protrudes from the underside of the housing.

4. The manual control component according to claim 1, wherein the switch element is supported such that it is pivotable about an axis that is arranged parallel to an upper side of the housing.

5. The manual control component according to claim 4, wherein the axis is formed by a pin that is supported in the housing.

6. The manual control component according to claim 5, wherein the pin consists of metal.

7. The manual control component according to claim 1, wherein the switch element features means for resetting the switch element into a neutral position.

8. The manual control component according to claim 7, wherein the resetting means comprise at least one spring.

9. The manual control component according to claim 1, further comprising a first and a second switch that are electrically coupled to the circuit arrangement, wherein the first switch is respectively actuatable due to an actuation of the first control surface as due to an actuation of the control lever in a first direction and the second switch is respectively actuatable as well due to an actuation of the second control surface as due to an actuation of the control lever in a second direction.

10. The manual control component according to claim 9, wherein the first and the second switch are formed as microswitches.

11. The manual control component according to claim 9, wherein the circuit arrangement is at least partially arranged on a circuit board in the interior of the housing, and wherein the first and the second switch are fixed and electrically contacted on the circuit board.

12. The manual control component according to claim 1, wherein the upper and the lower part of the switch element are made of plastic or ABS plastic.

13. The manual control component according to claim 1, wherein the upper and the lower part of the switch element are jointly realized in the form of a one-piece component.

14. The manual control component according to claim 1, wherein the underside of the housing features in the region of the switch element or in the region of the control lever a recess, which is reachable by a user of the manual control component for actuating the control lever.

15. An electrically adjustable piece of seating furniture with a manual control component, the manual control component comprising:

a housing;

a switch element with an upper part that features a flat, upwardly directed control panel with a first and a second control surface, as well as a lower part that features a downwardly directed control lever that is directly connected to the upper part in a rigid fashion, wherein the switch element is pivotably supported in the housing;

a circuit arrangement that is designed for detecting a pivoting motion of the switch element and for generating a signal in order to activate a drive of the piece of seating furniture in dependence on the detected pivoting motion; and wherein the upwardly directed control panel moves with an actuation of the downwardly directed control lever.

16. The piece of seating furniture according to claim 15, the manual control component further comprising a first and a second switch that are electrically coupled to the circuit arrangement, wherein the first switch is respectively actuatable as well due to an actuation of the first control surface as due to an actuation of the control lever in a first direction and the second switch is respectively actuatable as well due to an actuation of the second control surface as due to an actuation of the control lever in a second direction.

17. The piece of seating furniture according to claim 15, wherein the control lever is actuatable both in a first direction and in a second direction.

18. The manual control component according to claim 1, wherein the control lever is actuatable both in a first direction and in a second direction.

* * * * *